US011324263B2

(12) United States Patent
Krull et al.

(10) Patent No.: US 11,324,263 B2
(45) Date of Patent: May 10, 2022

(54) FISHING WADER WITH BREATHABLE STOCKING FOOT BOOTIE

(71) Applicant: Simms Fishing Products LLC, Bozeman, MT (US)

(72) Inventors: Clay Krull, Bozeman, MT (US); Robert Gibson, Bozeman, MT (US); Sam James, Bozeman, MT (US)

( * ) Notice: Subject to any disclaimer, the term of this patent is extended or adjusted under 35 U.S.C. 154(b) by 242 days.

(21) Appl. No.: 16/699,604

(22) Filed: Nov. 30, 2019

(65) Prior Publication Data

US 2021/0161222 A1 Jun. 3, 2021

(51) Int. Cl.
*A41D 13/02* (2006.01)
*A41D 31/102* (2019.01)

(52) U.S. Cl.
CPC ..... *A41D 13/02* (2013.01); *A41D 31/102* (2019.02); *A41D 2600/106* (2013.01)

(58) Field of Classification Search
CPC ..... A41D 13/02; A41D 2600/106; A41D 13/012; A41D 17/02
See application file for complete search history.

(56) References Cited

U.S. PATENT DOCUMENTS 1,983,880 A * 12/1934 Reiss ..... A41D 13/02 2/80
2,132,668 A * 10/1938 Wittmack ..... A41D 13/02 2/227
2,507,382 A * 5/1950 Norvich ..... A41D 13/02 2/80
4,222,183 A 9/1980 Haddox
4,898,007 A 2/1990 Dahlgren
5,022,096 A * 6/1991 Pacanowsky ..... A41D 27/24 2/227
5,067,260 A * 11/1991 Jenkins, Jr. ..... A43B 3/02 36/7.1 R
5,095,548 A 3/1992 Chesebro, Jr.
RE33,966 E * 6/1992 Robison ..... A41D 13/02 2/227
5,319,807 A 6/1994 Brier
5,353,524 A 10/1994 Brier
5,359,731 A * 11/1994 Cavalier ..... A41D 1/06 2/227
5,365,677 A 11/1994 Dalhgren
5,511,323 A 4/1996 Dahlgren
5,746,013 A 5/1998 Fay, Sr.
7,913,420 B2 3/2011 Arizumi
8,146,266 B2 3/2012 Vattes et al.
9,723,891 B2 8/2017 Xanthos et al.
(Continued)

*Primary Examiner* — Alissa L Hoey
(74) *Attorney, Agent, or Firm* — Antoinette M. Tease

(57) ABSTRACT

A fishing wader with a body portion and a pair of booties. The body portion has a front pocket assembly made of three stacked layers of material, including an outer layer having a plurality of hexagonal-shaped holes, a water-permeable middle layer, and a water-permeable inner layer. Each bootie has a toe piece, an ankle piece, and a sole piece. The toe piece has a top layer that is a laminated composite material including a waterproof breathable membrane. The toe piece also has a middle layer that is made of a durable and resilient waterproof material with a plurality of cutouts that penetrate completely through the middle layer. The toe piece also has a bottom layer. The durometer of the sole piece is preferably higher than the durometer of the toe and ankle pieces.

8 Claims, 6 Drawing Sheets

(56) References Cited

U.S. PATENT DOCUMENTS 10,863,817 B2 * 12/2020 Yeates ..... A45F 5/00
2001/0025383 A1 * 10/2001 Thompson ..... A41D 13/02 2/69
2005/0233658 A1 * 10/2005 Tien ..... B32B 5/245 442/59
2005/0241179 A1 11/2005 Chen
2006/0277785 A1 12/2006 Vattes et al.
2007/0256328 A1 11/2007 Arizumi
2009/0282602 A1 * 11/2009 Lepage ..... B29C 66/73921 2/82
2010/0205717 A1 * 8/2010 McClintock ..... A43B 13/122 2/82
2012/0317841 A1 12/2012 Taylor et al.
2013/0000148 A1 1/2013 Gellis
2013/0219747 A1 8/2013 Lederer
2013/0291293 A1 * 11/2013 Jessiman ..... A43B 7/125 2/459
2014/0352178 A1 12/2014 Bruce et al.
2015/0342272 A1 * 12/2015 Bonime ..... A41D 13/02 2/230
2016/0302515 A1 10/2016 Xanthos et al.
2017/0208872 A1 * 7/2017 Shih ..... B32B 5/26
2017/0208875 A1 * 7/2017 Shih ..... A41D 31/065
2017/0306539 A1 * 10/2017 Gladish ..... A43B 23/0225
2018/0295904 A1 * 10/2018 Looper ..... A43B 7/12
2019/0110547 A1 * 4/2019 Wu ..... A43B 7/12
2019/0387811 A1 * 12/2019 Gibson ..... A41D 13/06
2019/0387812 A1 * 12/2019 Chaney ..... B32B 5/06
2020/0008497 A1 * 1/2020 Shih ..... A41D 13/012
2020/0060365 A1 * 2/2020 Shih ..... A43B 1/08
2020/0121000 A1 * 4/2020 Wood ..... A41D 13/02
2020/0196688 A1 * 6/2020 Beernink ..... A41D 13/012
2021/0030080 A1 * 2/2021 Lee ..... A43B 3/02

* cited by examiner

FISHING WADER WITH BREATHABLE STOCKING FOOT BOOTIE

BACKGROUND OF THE INVENTION

1. Field of the Invention

The present invention relates generally to the field of fishing waders, and more particularly, to a stockingfoot wader in which a portion of the foot section is fabricated with perforated neoprene fabric.

2. Description of the Related Art

There are numerous examples in the prior art that describe footwear which is designed to minimize the buildup of perspiration moisture within a shoe or sock. Some of these inventions are described below. None of these inventions is specifically designed to be incorporated with a fishing wader, and none possesses the unique multiple-layer structural features of the present invention, including, but not limited to, the bootie constructed of perforated neoprene, as described more fully below.

U.S. Pat. No. 4,222,183 (Haddox, 1980) discloses a reinforced, ventilated athletic shoe that comprises multiple pieces of air penetrable netting that are positioned between and attached to strips of conventional shoe cover material such as leather or cloth.

U.S. Pat. No. 4,898,007 (Dahlgren, 1990) discloses a moisture management sock in which the toe and heel portions are fabricated from knitted hydrophilic yarn, while the instep and other portions are fabricated from knitted hydrophobic yarn, so that water absorbed from the foot by the hydrophilic portions of the sock is wicked into the hydrophobic portions of the sock, where it is evaporated.

U.S. Pat. No. 5,095,548 (Chesebro, Jr., 1992) discloses a moisture control sock that comprises a combination of hydrophilic and hydrophobic yarns, wherein the hydrophilic and hydrophobic yarns have cut free ends, and wherein the endmost stitch loops of the hydrophobic and hydrophilic yarns are formed in adjacent wales.

U.S. Pat. No. 5,319,807 (Brier, 1994) discloses a moisture-management sock and shoe combination. The sock portion of the invention includes a multi-layer moisture wicking panel that extends from the front ankle portion to the front toe portion. The moisture wicking panels of the sock portion are fabricated from hydrophilic and hydrophobic yarns. The shoe portion of the invention includes a tongue, a toe box area, and a moisture wicking inner liner. The tongue of the shoe portion includes an outer layer of fabric such as nylon and a foam padding layer. The toe box area comprises and outer protective layer and an inner wicking fabric layer comprised of hydrophilic fibers. The moisture wicking inner liner is fabricated from one layer of hydrophilic and one layer of hydrophobic fabric. The claims of this patent cover the sock portion of the invention.

U.S. Pat. No. 5,353,524 (Brier, 1994) is similar to U.S. Pat. No. 5,319,548 above. The claims of the patent cover the shoe portion of the invention.

U.S. Pat. No. 5,265,677 (Dalhgren, 1994) discloses a sock and shoe combination that provides removal and dissipation of perspiration from the feet of a wearer. The sock portion of the invention comprises a combination of hydrophilic and hydrophobic fibers that wick moisture away from the foot. The shoe portion of the invention includes a tongue which is comprised of multiple layers of hydrophilic and hydrophobic material that wick moisture away from the outer surface of the sock portion of the invention and allow it to evaporate into the atmosphere.

U.S. Pat. No. 5,511,323 (Dahlgren, 1996) discloses a sock and shoe combination that facilitates the removal and dissipation of perspiration from the foot of a wearer. The knitted sock has a toe portion fabricated from hydrophilic material and an instep portion fabricated from hydrophobic foam. The shoe comprises a tongue portion which is fabricated from multiple stacked layers of hydrophilic and hydrophobic material.

U.S. Pat. No. 5,746,013 (Fay, Sr., 1998) discloses a shoe having a breathable liner, in which the liner is attached to the upper inside surface of the shoe, and in which the liner is comprised of an outer knit hydrophilic material, an inner knit hydrophobic material, and a middle layer comprised of monofilament hydrophobic yarns that provides air chambers between the outer and inner layers.

U.S. Pat. No. 7,913,420 (Arizumi, 2011) discloses a skateboard shoe with a textured surface portion. The textured surface portion may be fabricated from a variety of polymer materials, and may optionally include apertures that allow air to pass into the shoe, and allow moisture to expire from the inside of the shoe into the air.

U.S. Pat. No. 8,146,266 (Vattes et al., 2012) discloses chimney structures for footwear and foot coverings. The chimney structures may be positioned on the inner sidewalls or the inner surface of the tongue of footwear, and provide pathways to vent heat and moisture away from the foot. The chimney structures may also be installed in socks, leggings, or other apparel.

U.S. Pat. No. 9,723,891 (Xanthos et al., 2017) discloses a rowing shoe that may optionally comprise sections made from air permeable materials that allow the shoe to breathe or ventilate. These sections may be formed in a mesh configuration and may be fabricated from any kinds of textile materials.

U.S. Patent Application Pub. No. US 2005/0241179 A1 (Chen, 2005) discloses a shoe with a breathable shell. The shell has a flexible corrugated portion that contains a plurality of vent holes.

U.S. Patent Application Pub. No. US 2012/0317841 (Taylor et al., 2012) discloses an athletic performance shoe which incorporates outer shell pieces and an optionally removable bootie. The outer shell pieces may be perforated to provide ventilation. The bootie may be made of "a porous material that can breathe to allow the ambient air circulation around the foot" [0034, lines 10-12].

U.S. Patent Application Pub. No. US 2013/0000148 (Gellis, 2013) discloses a molded foot covering fabricated from an elastomeric material that preferably contains openings or perforations for breathability.

U.S. Patent Application Pub. No. US 2013/0219747 (Lederer, 2013) discloses an air-permeable tongue for shoes. The interior lining of the tongue is fabricated from breathable material and comprises a longitudinal slit to allow air circulation.

U.S. Patent Application Pub. No. US 2014/0352178 (Bruce, et al., 2014) discloses a type of ventilated footwear which consists of a shoe and a sock which is insertable into the shoe. The shoe contains at least one ventilation port. The sock contains plurality of moisture wicking panels, at least one of which is in fluid communication with the ventilation port of the shoe. The moisture wicking panels of the sock may be made from natural or man-made hydrophilic materials.

BRIEF SUMMARY OF THE INVENTION

The present invention is a fishing wader comprising: a body portion comprising a suspender assembly having two suspender straps, each suspender strap having a front end and a rear end, the front ends of the suspender straps being attached with stitching to two top extensions of a front pocket assembly, the front pocket assembly being attached with stitching to a chest piece, the rear ends of the suspender straps being attached with stitching to a top edge of a back piece; and a pair of booties, each bootie comprising a toe piece, an ankle piece, and a sole piece, the toe piece having: a top layer comprised of a laminated composite material, the laminated composite material comprising a waterproof breathable membrane; a middle layer comprised of a durable and resilient waterproof material, the material comprising a plurality of cutouts that penetrate completely through the middle layer; and a bottom layer; wherein the front pocket assembly is comprised of three stacked layers of material, the three stacked layers of material comprising an outer layer having a plurality of hexagonal-shaped holes, a water-permeable middle layer, and a water-permeable inner layer; wherein each of the three stacked layers of material has an outside edge, and the three stacked layers of material are attached to each other and to the chest piece by stitching around at least a portion of the outside edges of the three layers of material; and wherein the water-permeable middle layer and the water-permeable inner layer are configured to form a pocket accessible by two front pocket openings.

In a preferred embodiment, the suspender assembly comprises a slidable clasp that is configured to allow a distance between the tops of the suspender straps to be adjusted to fit a shoulder width of a wearer. Preferably, the outer layer of the front pocket assembly is comprised of high-strength nylon and configured to form an attachment face for fishing accessories on an outside of the front pocket assembly via the plurality of hexagonal-shaped holes; the middle layer of the front pocket assembly is comprised of stretchable polymer mesh fabric; and the inner layer of the front pocket assembly is comprised of a woven polymer fabric. The wader preferably comprises a vertically-oriented left side zipper that is adhered between a left edge of the chest piece and a left edge of the back piece and a vertically-oriented right side zipper that is adhered between a right edge of the chest piece and a right edge of the back piece; wherein the wader has a top circumference, and the left and right zippers arc configured so that the top circumference of the wader is smaller when the zippers are fully zipped than when the zippers are unzipped.

In a preferred embodiment, the plurality of indentations in the middle layer of the toe piece are hexagonal. Preferably, each of the toe piece, ankle piece and sole piece has a durometer, the durometer of the toe piece and the durometer of the ankle piece is 11 using Gs-701N Type C durometer tester, and the durometer of the sole piece is 18 using Gs-701N Type C durometer tester.

In one embodiment, the bottom layer of the toe piece is comprised of a knitted fiber material. In another embodiment, the bottom layer of the toe piece is comprised of a woven fiber material. In yet another embodiment, the bottom layer of the toe piece is comprised of a breathable composite material.

The present invention is a fishing wader comprising: a body portion; and a pair of booties, each bootie comprising a toe piece, an ankle piece, and a sole piece, the toe piece having: a top layer comprised of a laminated composite material, the laminated composite material comprising a waterproof breathable membrane; a middle layer comprised of a durable and resilient waterproof material, the material comprising a plurality of cutouts that penetrate completely through the middle layer; and a bottom layer.

REFERENCE NUMBERS

Figure 1:
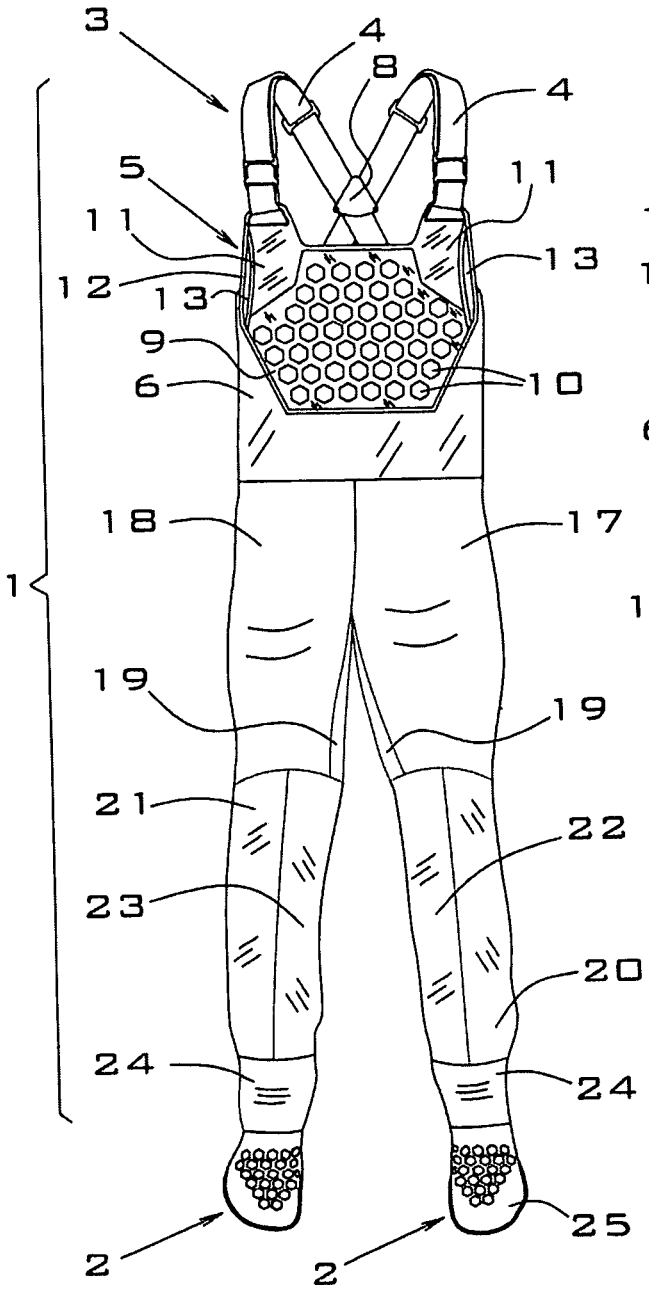
FIG. 1 is a front view of the present invention, which is a stockingfoot fishing wader.

1 Body portion
2 Bootie
3 Suspender assembly
4 Suspender straps
5 Front pocket assembly
6 Chest piece
7 Back piece
8 Slidable clasp
9 Outer layer of front pocket assembly
10 Hexagonal holes in outer layer of the front pocket assembly
11 Middle layer of front pocket assembly
12 Inner layer of front pocket assembly
13 Front pocket opening
14 Left side zipper
15 Right side zipper
16 Belt loop
17 Left upper leg piece
18 Right upper leg piece
19 Gusset piece
20 Left outside lower leg piece
21 Right outside lower leg piece
22 Left inside lower leg piece
23 Right inside lower leg piece
24 Gravel guard
25 Toe piece of bootie
26 Ankle piece of bootie
27 Sole piece of bootie
28 Waterproof tape
29 Hexagonal indentation in the top layer of the toe piece
30 Toe piece material
31 Top layer of toe piece material
32 Middle layer of toe piece material
33 Holes through middle layer of toe piece material
35 Bottom layer of toe piece material
35 Front pocket zipper
36 Pleat in wader top
37 Waterproof fabric backing piece for side zipper

DETAILED DESCRIPTION OF INVENTION

A. Overview

As used herein, the following terms shall have the following meanings:

"Left" and "right" refer to a wader wearer's left and right sides, respectively.

"Adhered" means attached with adhesive and/or stitching and covered with waterproof tape.

"Breathable" means permeable to air and water vapor.

"Waterproof" means impermeable to liquid water.

The present invention is a stockingfoot wader having a body portion and a pair of booties. The body portion of the wader is comprised of multiple pieces including a suspender assembly, a front pocket assembly, a chest piece, a back piece, a left upper leg piece, a right upper leg piece, a gusset (or crotch) piece, a left outer lower leg piece, a right outer lower leg piece, a left inner lower leg piece, a right inner lower leg piece and a pair of gravel guards. The chest piece, back piece, left upper leg piece and right upper leg piece are manufactured from three-layer laminated breathable waterproof fabric that is selected for maximum breathability. The left outer lower leg piece, a right outer lower leg piece, a left inner lower leg piece, and right inner lower leg piece are manufactured from four-layer laminated nylon breathable and waterproof fabric that is selected for maximum resistance to puncture and abrasion damage. The gusset is manufactured from three-layer laminated stretchable breathable and waterproof material that provides maximum range of movement for the legs when a wearer is walking. The gravel guards are manufactured from jersey-covered perforated neoprene, with the perforations reducing their weight.

Each bootie comprises a toe piece, an ankle piece and a sole piece. The toe piece is comprised of three layers of at least two different materials including an outer layer that comprises a waterproof breathable membrane, a middle layer that comprises an insulating and stretchable non-breathable material such as neoprene which has been modified with perforations or cut holes, and an inner layer comprised of either a second layer comprising a waterproof breathable membrane or a knit or woven jersey fabric material. The ankle piece and sole piece are comprised of an insulating and stretchable neoprene material that is covered on both sides with fabric backing. The inside surface of the bootie is treated with an antimicrobial agent to prevent odor.

B. Detailed Description of the Figures

Figure 2:
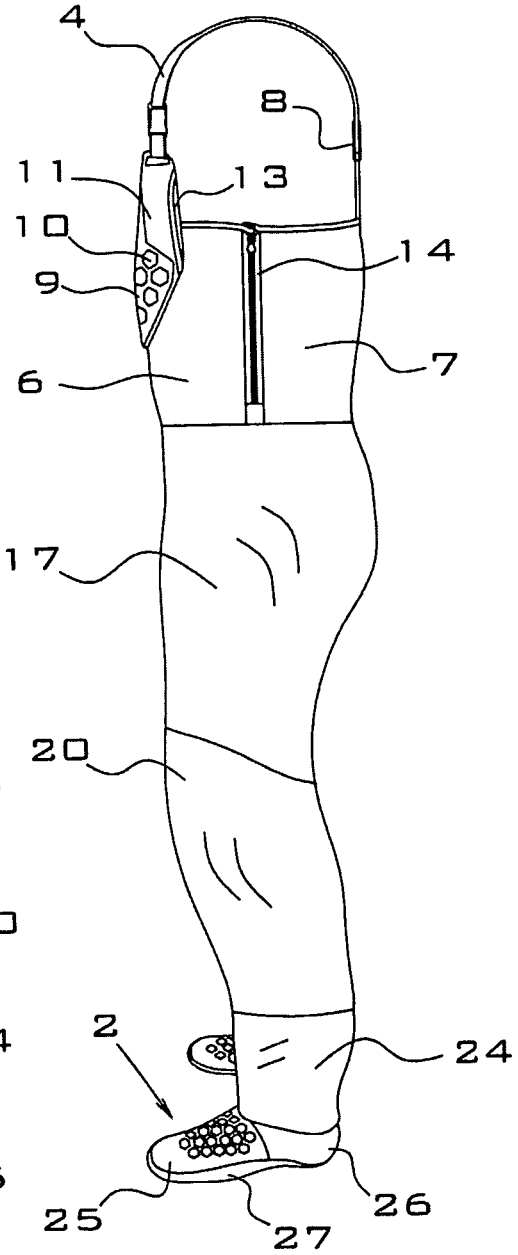
FIG. 2 is a left side view of the present invention.
Figure 3:
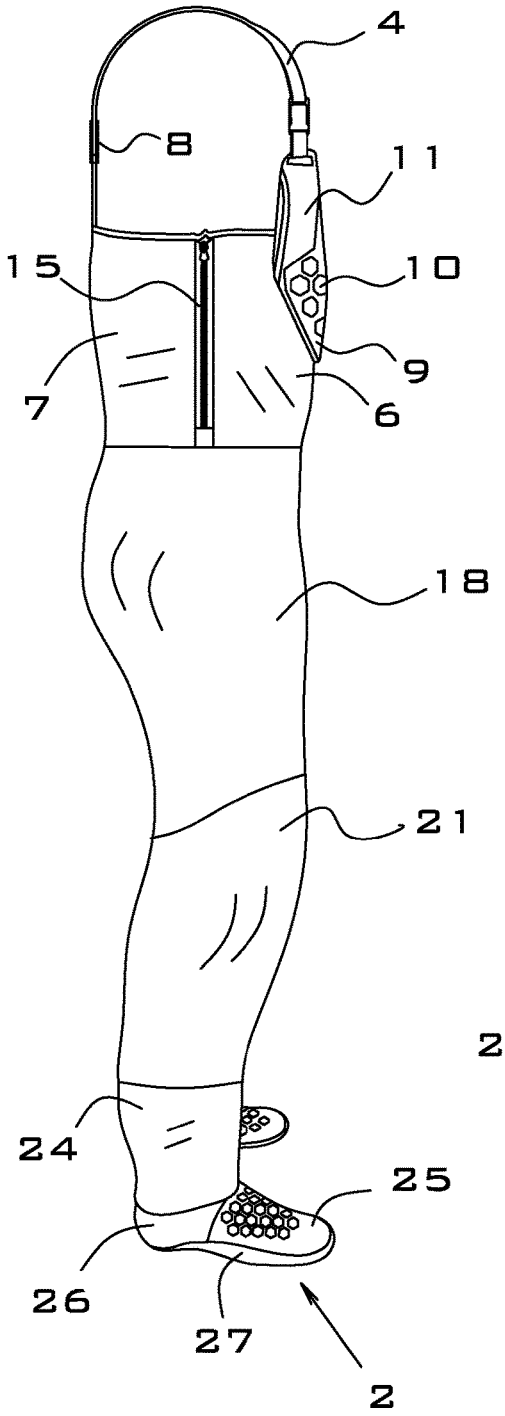
FIG. 3 is a right side view of the present invention.
Figure 4:
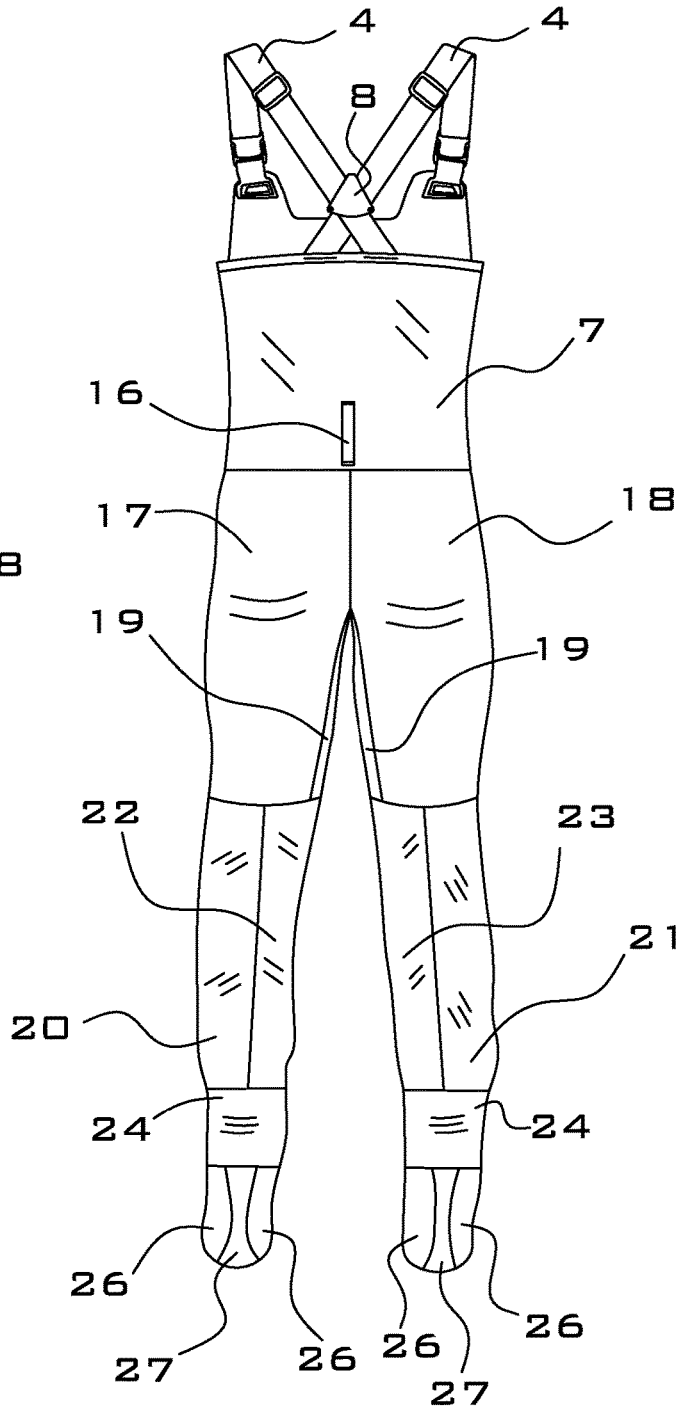
FIG. 4 is a rear view of the present invention.

FIG. 1 is a front view of the present invention, which is a stockingfoot fishing wader. FIG. 2 is a left side view of the present invention. FIG. 3 is a right side view of the present invention. FIG. 4 is a rear view of the present invention. As shown in FIGS. 1 through 4, the present invention is comprised of a body portion 1 and a pair of booties 2. The body portion 1 comprises a suspender assembly 3 having two suspender straps 4. The front ends of the suspender straps 4 are attached with stitching to two top extensions of a front pocket assembly 5, which is attached with stitching to the chest piece 6. The rear ends of the two suspender straps 4 are attached with stitching to the top edge of the back piece 7. The suspender assembly 3 is equipped with a slidable clasp 8 that allows the distance between the tops of the suspender straps 4 to be adjusted to fit the shoulder width of a wearer, thereby providing a comfortable fit for wearers with either wide or narrow shoulders.

The front pocket assembly 5 is comprised of three stacked layers of material, consisting of an outer layer 9 having a plurality of hexagonal-shaped holes 10, a water-permeable middle layer 11, and a water-permeable inner layer 12. The three layers 9, 11, and 12 are attached to each other and to the chest piece 6 by stitching around a portion of the outside edges of the three layers. Two front pocket openings 13 allow hand access into a pocket formed within the space between the middle layer 11 and the inner layer 12.

The material of the outer layer 9 is a patented, commercially available fabric named HEXGRID®, comprised of high-strength nylon, manufactured by 5.11, Inc. of Modesto, Calif. The outer layer 9 forms an attachment face for fishing accessories such as fly boxes, bear spray, etc., which may be removably attached to the outside of the front pocket assembly via the hexagonal holes 10. The hexagonal holes 10 are in the shape of regular hexagons, each having a side length of approximately 1.5 centimeters, and with a spacing between adjacent parallel sides of adjacent holes 10 of approximately 0.5 centimeter. The middle layer 11 of the front pocket assembly 5 is comprised of stretchable, highly permeable polymer mesh fabric. The inner layer 12 of the front pocket assembly 5 is comprised of a permeable woven polymer fabric.

As shown in FIG. 2, a generally vertically-oriented left side zipper 14 (shown in the zipped position) is adhered between the left edge of the chest piece 6 and the left edge of the back piece 7. As shown in FIG. 3, a generally vertically-oriented right side zipper 15 (also shown in the zipped position) is adhered between the right edge of the chest piece 6 and the right edge of the back piece 7. As described in detail in reference to FIGS. 11 and 12, when the two zippers are unzipped, the circumference of the top of the wader has a maximum circumference, enabling a wearer to easily don the wader; when the zippers are zipped up, the circumference of the top of the wader is reduced, providing a trimmer and snugger fit. A belt loop 16 is adhered to the lower center of the back piece 7 for use with an optional wader belt (not shown).

The bottom left edge of the chest piece 6 is adhered to the top edge of the left upper leg piece 17, and the bottom right edge of the chest piece 6 is adhered to the top edge of the right upper leg piece 18. The inside edges of the left upper leg piece 17 and the right upper leg piece 18 are adhered to the left and right edges, respectively, of the gusset piece 19. A portion of the bottom edge of the left upper leg piece 17 is adhered to the top edge of the left outside lower leg piece 20. A portion of the bottom edge of the right upper leg piece 18 is adhered to the top edge of the right outside lower leg piece 21. A portion of the bottom edge of the left upper leg piece 17 and the bottom left edge of the gusset piece 19 are adhered to the top edge of the left inside lower leg piece 22. A portion of the bottom edge of the right upper leg piece 18 and the bottom right edge of the gusset 19 piece are adhered to the top edge of the right inside lower leg piece 23. The front edge of the left outside lower leg piece 20 is adhered to the front edge of the left inside lower leg piece 22, and the front edge of the right outside lower leg piece 21 is adhered to the front edge of the right inside lower leg piece 23. The fabric pieces 17-23 are shaped so that the knee of the wearer is covered by four-layer, maximum durability material, while the back of the knee is covered with three-layer, flexible material. The top edge of a gravel guard 24 and a bootie 2 are adhered to the bottom edges of the left outside lower leg piece 20 and the left inside lower leg piece 22, and to the lower edges of the right outside lower leg piece 21 and the right inside lower leg piece 23. The bottom edges of the gravel guards 24 are not adhered to other pieces of material, and are therefore free to be pulled up or down over the tops of the booties 2 and wading shoes (not shown).

Figure 5:
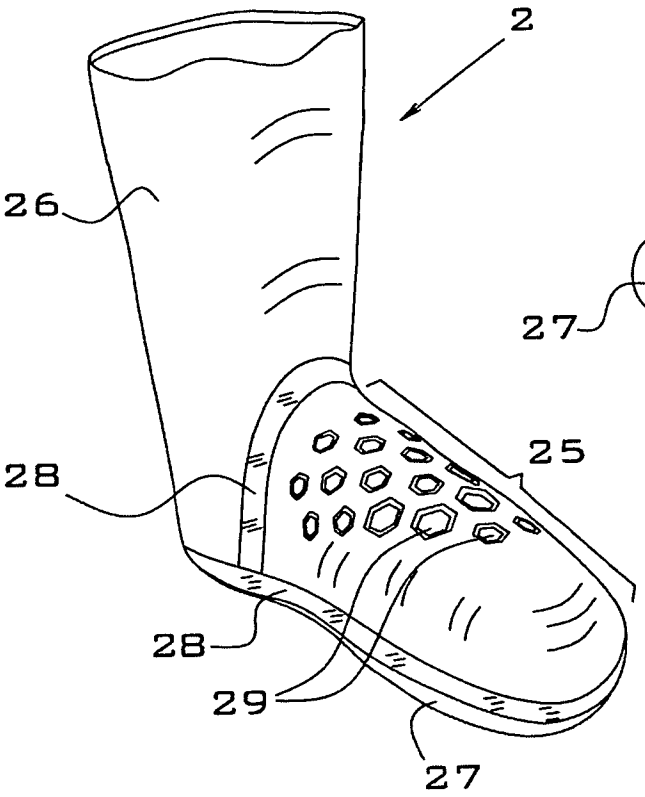
FIG. 5 is a perspective view of one bootie showing the top and front sides of the bootie.

FIG. 5 is a perspective view of one bootie 2 showing the top and front sides of the bootie 2. The bootie 2 is comprised of a toe piece 25, an ankle piece 26, and a sole piece 27. Waterproof tape 28 covers the seam between the toe piece 25 and the ankle piece 26, and also covers the seam between the toe piece 25 and the sole piece 27. Hexagonal indentations 29 in the top layer of the toe piece 25 occur where the material of the top layer of the toe piece 25 has been pulled downward into the hexagonal cutouts of the middle layer (explained in detail in reference to FIGS. 7 and 8) of the toe piece 25.

Figure 6:
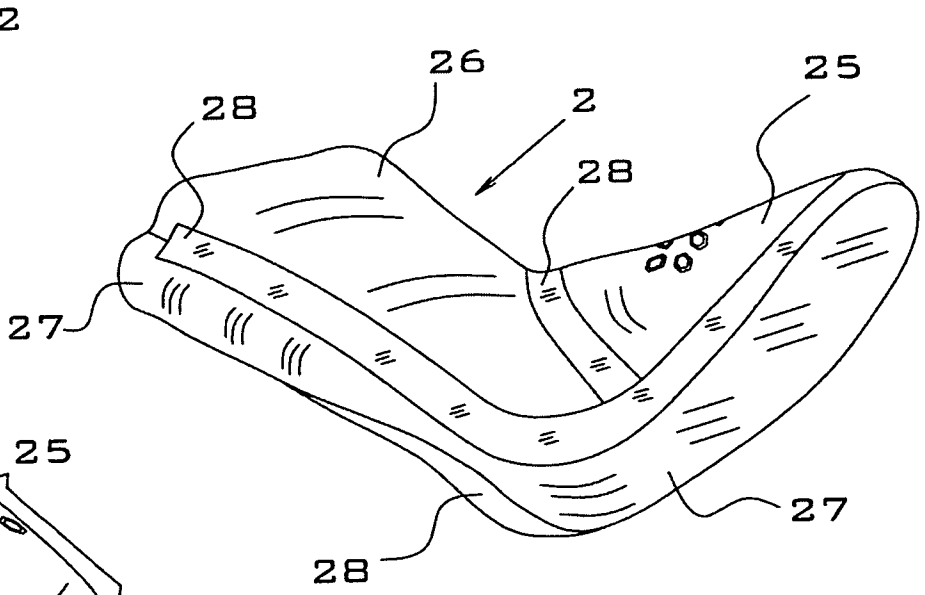
FIG. 6 is a perspective view of one bootie showing the bottom and rear sides of the bootie.

FIG. 6 is a perspective view of one bootie 2 showing the bottom and rear sides of the bootie 2. Waterproof tape 28 covers the seam between ankle piece 26 and the sole piece 27. As shown in FIGS. 5 and 6, the toe piece 25 extends over an area from the wearer's toes to the instep; the ankle piece 26 extends over an area that covers the wearer's ankle and lower shin; and the sole piece 27 extends over an area covering the wearer's foot bottom and the back of the lower calf.

Figure 7:
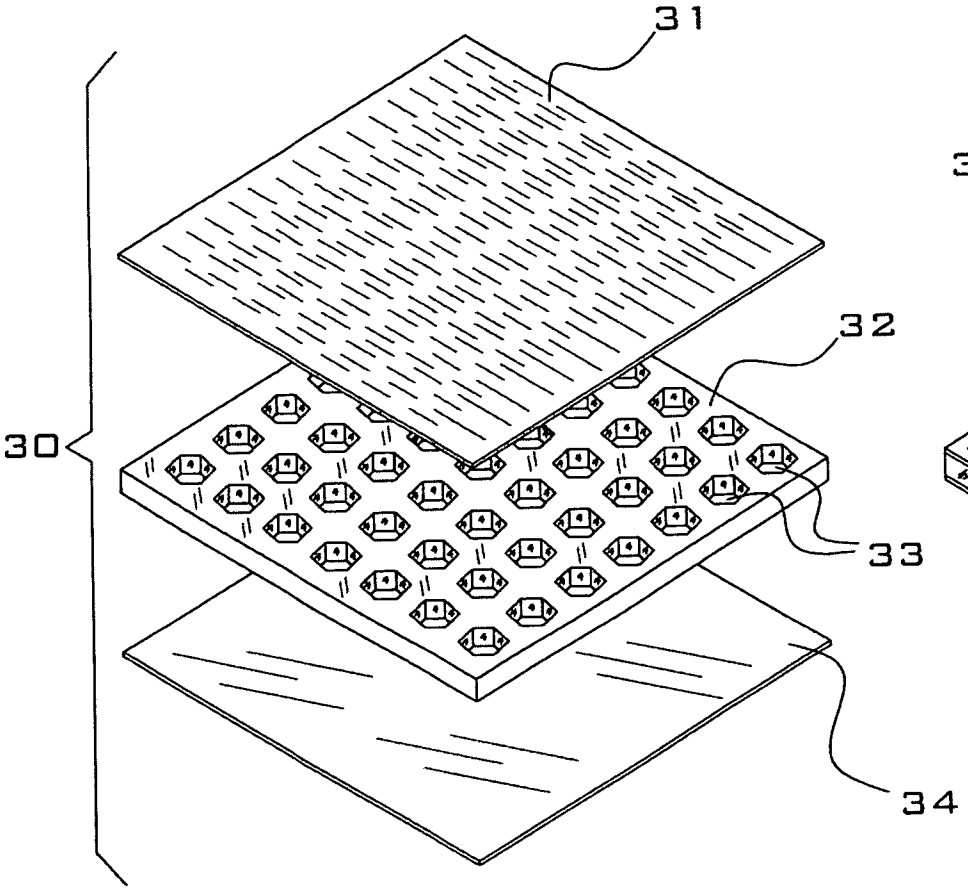
FIG. 7 is an exploded isometric view of the toe piece material, showing the three layers that comprise the toe piece material, prior to bonding of the layers or shaping the toe piece.

FIG. 7 is an exploded isometric view of the toe piece material 30, showing the three layers that comprise the toe piece material 30, prior to bonding of the three layers or shaping the toe piece 25 (shown in FIGS. 5 and 6). In a first embodiment, the top layer 31 of the toe piece material 30 is a laminated composite material that comprises a waterproof breathable membrane. The top layer 31 may optionally comprise one or more layers of permeable protective fabric on one or both sides of the waterproof breathable membrane. The top layer 31 is preferably a preassembled, commercially available or a preassembled, custom manufactured material. One example of a suitable preassembled material is GORE-TEX®, manufactured by W. L. Gore & Associates, Inc. of Newark, Del. GORE-TEX® is a laminate material that comprises an abrasion resistant outer shell, an internal stretched polytetrafluorethylene breathable membrane, and a protective wicking underlayer.

The middle layer 32 of the toe piece material 30 is comprised of a durable and resilient waterproof material such as rubber, latex, or synthetic rubber such as silicone, neoprene, nitrile, or latex, which has been modified by the addition of strategically cut or punched holes 33 that penetrate completely through the material of the middle layer 32. Although the hole shape or size is not critical, in the example shown in FIG. 7, the perforations or cut holes 33 in the middle layer 32 are regular hexagonal in shape, with the sides each hexagon having a length of approximately one centimeter, with a spacing between parallel sides of adjacent hexagonal holes of approximately one centimeter, and a percentage of cutout area of approximately 50% of the surface area of the material of the middle layer 32. The nominal thickness of the neoprene in the toe piece, the ankle piece and the sole piece is 4 millimeters. The durometer of the toe and ankle pieces 25, 26 is approximately 11 (using Gs-701N Type C durometer tester), and the durometer of the sole piece 27 is approximately 18 (using Gs-701N Type C durometer tester). The three layers of material comprising the toe piece are bonded together with a film or liquid adhesive, which is applied to both sides of the middle layer. The bonding process requires controlled conditions of compression, temperature, and curing time to provide optimal adhesion of the three layers.

In a first embodiment, the bottom layer 34 of the toe piece material 30 is comprised of a knitted or woven fiber material such as jersey fabric. The material of the bottom layer 34 is selected so as to provide moisture wicking, in order to transfer foot perspiration away from the foot, through the holes 33 of the middle layer 32, and out to the atmosphere through the breathable membrane of the top layer 31. In a second embodiment, the bottom layer 34 is comprised of a second layer of breathable composite material similar to the top layer material 31, rather than knitted or woven fiber material.

Figure 8:
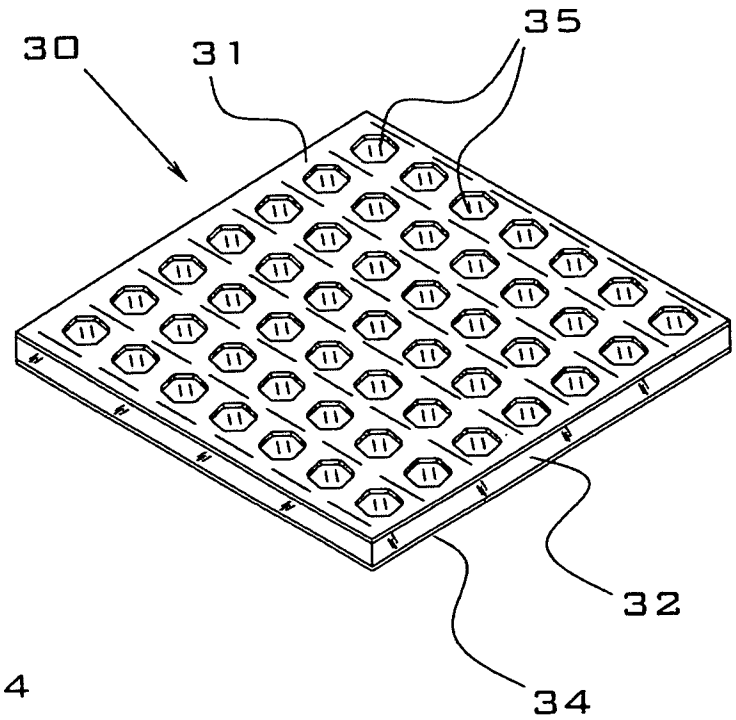
FIG. 8 is an isometric view of the toe piece material after the three layers have been bonded together.

FIG. 8 is an isometric view of the toe piece material 30 after the three layers 31, 32, and 34 have been bonded together. As shown, the bonding process results in a visible pattern of hexagonal indentations 29 in the top layer 31. These indentations are not required for functionality of the material, but they provide aesthetic appeal.

Figure 9:
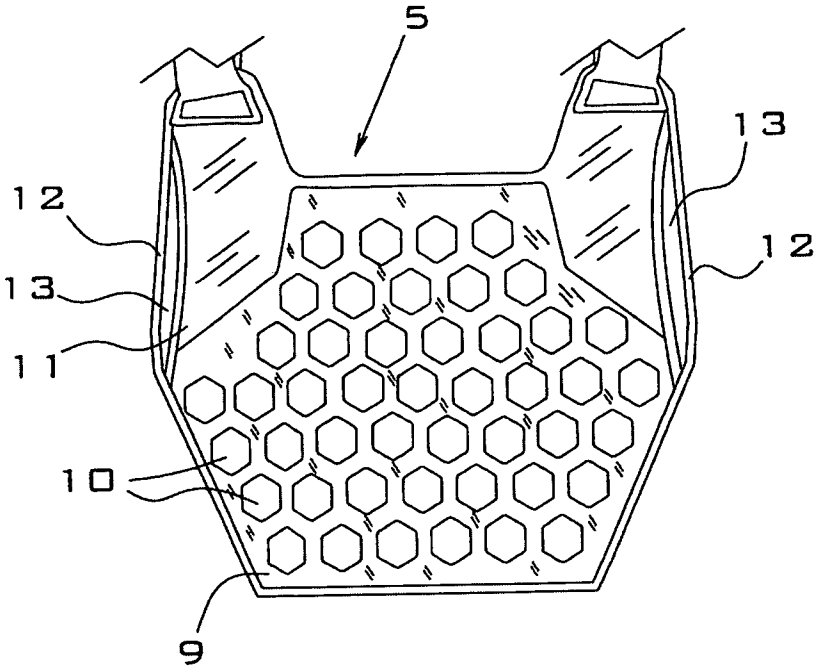
FIG. 9 is a front view of the front pocket assembly shown removed from the wader.

FIG. 9 is a front view of the front pocket assembly 5 shown removed from the wader, showing the outer layer 9 comprising hexagonal-shaped holes 10, the middle layer 11, outside edges of the inner layer 12, and two front pocket openings 13 that allow hand access to the space between the middle layer 11 and the inner layer 12.

Figure 10:
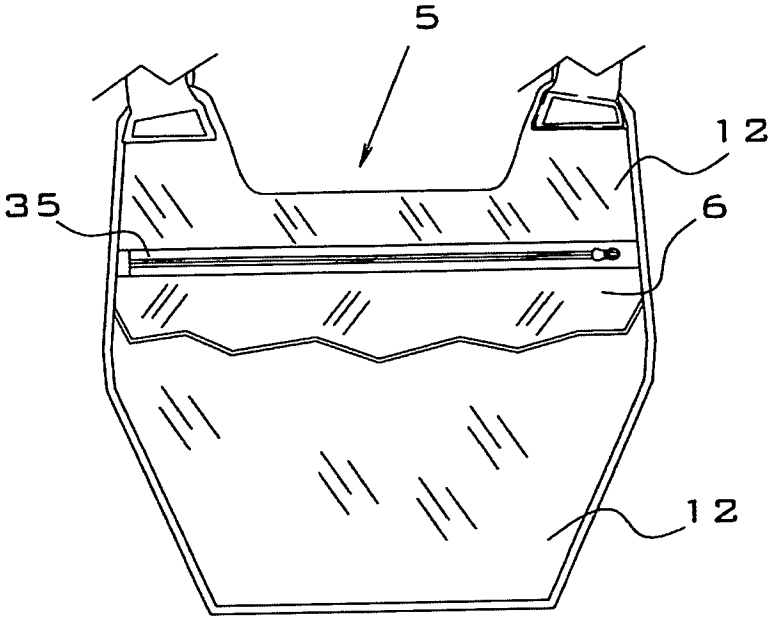
FIG. 10 is a rear view of the front pocket assembly shown with the wader partially removed for clarity.

FIG. 10 is a rear view of the front pocket assembly 5 shown with the wader partially removed for clarity, showing the inner layer 12 of the front pocket assembly 5, a portion of the inside surface of the top edge of the chest piece 6, and a horizontal front pocket zipper 35. The top edge of the front pocket zipper 35 is stitched to the inner layer 12 of the front pocket assembly 5, while the bottom edge of the front pocket zipper 35 is stitched to the chest piece 6, thereby forming a zippered pocket within the space between the inside surface of the inner layer 12 and the outside surface of the chest piece 6.

Figure 12:
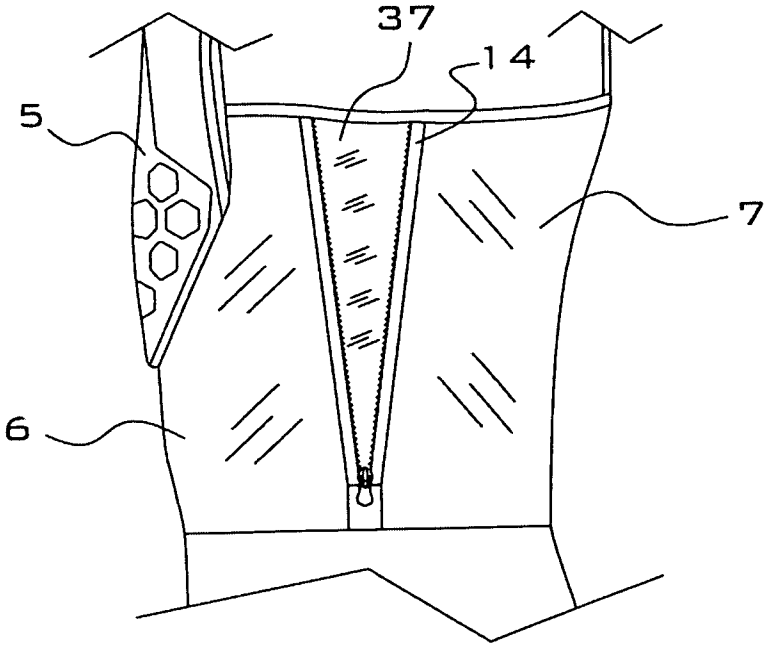
FIG. 12 is a partial left side view of the wader body, showing the left side zipper in an unzipped position.
Figure 11:
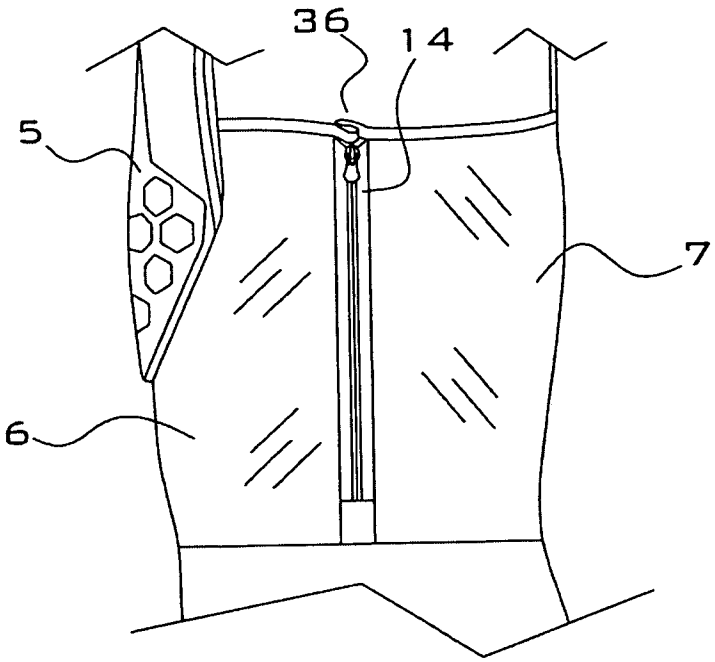
FIG. 11 is a partial left side view of the wader body, showing the left side zipper in a zipped position.

FIG. 11 is a partial left side view of the wader body, showing the left side zipper 14 in a zipped position. FIG. 12 is a partial left side view of the wader body, showing the left side zipper 14 in an unzipped position. The left side zipper 14 is installed into the wader body such that when the left side zipper 14 is zipped up as shown in FIG. 11, a pleat 36 is formed in the material at the top of the wader behind the zipper, thereby effectively reducing the circumference of the wader top. When the left side zipper 14 is unzipped, as shown in FIG. 12, the pleat 37 is removed, thereby restoring the full circumference of the wader top. The structure and operation of the right side zipper 15 (shown in FIG. 3) is identical to the left vertical side zipper 14. In a preferred embodiment, each side zipper 14, 15 provides about 5 centimeters of increase in the top circumference of the wader when the zipper is moved from the zipped to the unzipped position. As shown, the wader comprises a waterproof fabric backing piece 37 that is installed behind the left side zipper 14 and which is attached to the left edge of the chest piece 6 and the left edge of the back piece 7, thereby preventing water from entering the wader when the left side zipper 14 is in either a zipped or unzipped position. A similar waterproof fabric backing piece (not shown) is installed behind the right side zipper 15.

We claim:

1. A fishing wader comprising:

(a) a body portion comprising a suspender assembly having two suspender straps, each suspender strap having a front end and a rear end, the front ends of the suspender straps being attached with stitching to two top extensions of a front pocket assembly, the front pocket assembly being attached with stitching to a chest piece, the rear ends of the suspender straps being attached with stitching to a top edge of a back piece; and (b) a pair of booties connected to a bottom part of the body portion, each bootie comprising a toe piece, an ankle piece, and a sole piece, the toe piece having:

(1) a top layer comprised of a laminated composite material, the laminated composite material comprising a waterproof breathable membrane;

(2) a middle layer comprised of a durable and resilient waterproof material, the material comprising a plurality of cutouts that penetrate completely through the middle layer; and (3) a bottom layer;

wherein the front pocket assembly is comprised of three stacked layers of material, the three stacked layers of material comprising an outer layer having a plurality of hexagonal-shaped holes, a water-permeable middle layer, and a water-permeable inner layer;

wherein each of the three stacked layers of material has an outside edge, and the three stacked layers of material are attached to each other and to the chest piece by stitching around at least a portion of the outside edges of the three layers of material; and wherein the water-permeable middle layer and the water-permeable inner layer are configured to form a pocket accessible by two front pocket openings.

2. The fishing wader of claim 1, wherein the suspender assembly comprises a slidable clasp that is configured to allow a distance between the tops of the suspender straps to be adjusted to fit a shoulder width of a wearer.

3. The fishing wader of claim 1, wherein the outer layer of the front pocket assembly is comprised of nylon and configured to form an attachment face for fishing accessories on an outside of the front pocket assembly via the plurality of hexagonal-shaped holes;

wherein the middle layer of the front pocket assembly is comprised of stretchable polymer mesh fabric; and wherein the inner layer of the front pocket assembly is comprised of a woven polymer fabric.

4. The fishing wader of claim 1, comprising a vertically-oriented left side zipper that is adhered between a left edge of the chest piece and a left edge of the back piece and a vertically-oriented right side zipper that is adhered between a right edge of the chest piece and a right edge of the back piece;

wherein the wader has a top circumference, and the left and right zippers are configured so that the top circumference of the wader is smaller when the zippers are fully zipped than when the zippers are unzipped.

5. The fishing wader of claim 1, wherein the plurality of cutouts in the middle layer of the toe piece are hexagonal.

6. The fishing wader of claim 1, wherein the bottom layer of the toe piece is comprised of a knitted fiber material.

7. The fishing wader of claim 1, wherein the bottom layer of the toe piece is comprised of a woven fiber material.

8. The fishing wader of claim 1, wherein the bottom layer of the toe piece is comprised of a breathable composite material.

* * * * *